US006616065B2

(12) United States Patent
Martin

(10) Patent No.: US 6,616,065 B2
(45) Date of Patent: Sep. 9, 2003

(54) NOZZLE DEVICE

(76) Inventor: Javier Martin, Vrakvagen 15, Gavle (SE), SE-804 24

( * ) Notice: Subject to any disclaimer, the term of this patent is extended or adjusted under 35 U.S.C. 154(b) by 0 days.

(21) Appl. No.: 10/281,953

(22) Filed: Oct. 29, 2002

(65) Prior Publication Data

US 2003/0080204 A1 May 1, 2003

(30) Foreign Application Priority Data

Oct. 29, 2001 (SE) ..... 0103580

(51) Int. Cl.[7] ..... B05B 15/02; F23D 11/34; F23D 11/38; F23D 14/50

(52) U.S. Cl. ..... 239/106; 239/104; 239/105; 239/107; 239/455

(58) Field of Search ..... 239/104, 105, 239/106, 107, 108, 109, 110, 112, 113, 114, 115, 119, 451, 452, 455, 546

(56) References Cited

U.S. PATENT DOCUMENTS 3,936,002 A * 2/1976 Geberth, Jr. ..... 239/455
4,913,344 A * 4/1990 Bauer ..... 239/112
5,211,335 A * 5/1993 Strid ..... 239/110
5,803,364 A * 9/1998 Martin ..... 239/107
5,899,384 A * 5/1999 Solbakke ..... 239/119

* cited by examiner

*Primary Examiner*—Robin O. Evans
(74) *Attorney, Agent, or Firm*—Young & Thompson

(57) ABSTRACT

A nozzle device includes a housing (1) having an inlet for a fluid and an orifice for spraying out a firm jet of fluid (38), which orifice is delimited by two or more members, at least one of which is movable relative to the other one between a first position in which the orifice has a minimal cross-section area in order to spray out the fluid in a firm jet in a forward direction from the housing, and a second position in which the orifice is widened in order to be flushed clean by a coarse stream of fluid. A cap (2) is arranged in front of the orifice, the cap having two or more shield walls (16, 17) in which there are holes (20, 21) through which the firm jet of fluid (38), but not the coarse stream of flushing fluid, may pass.

5 Claims, 4 Drawing Sheets

NOZZLE DEVICE

TECHNICAL FIELD OF THE INVENTION

Figure 1:
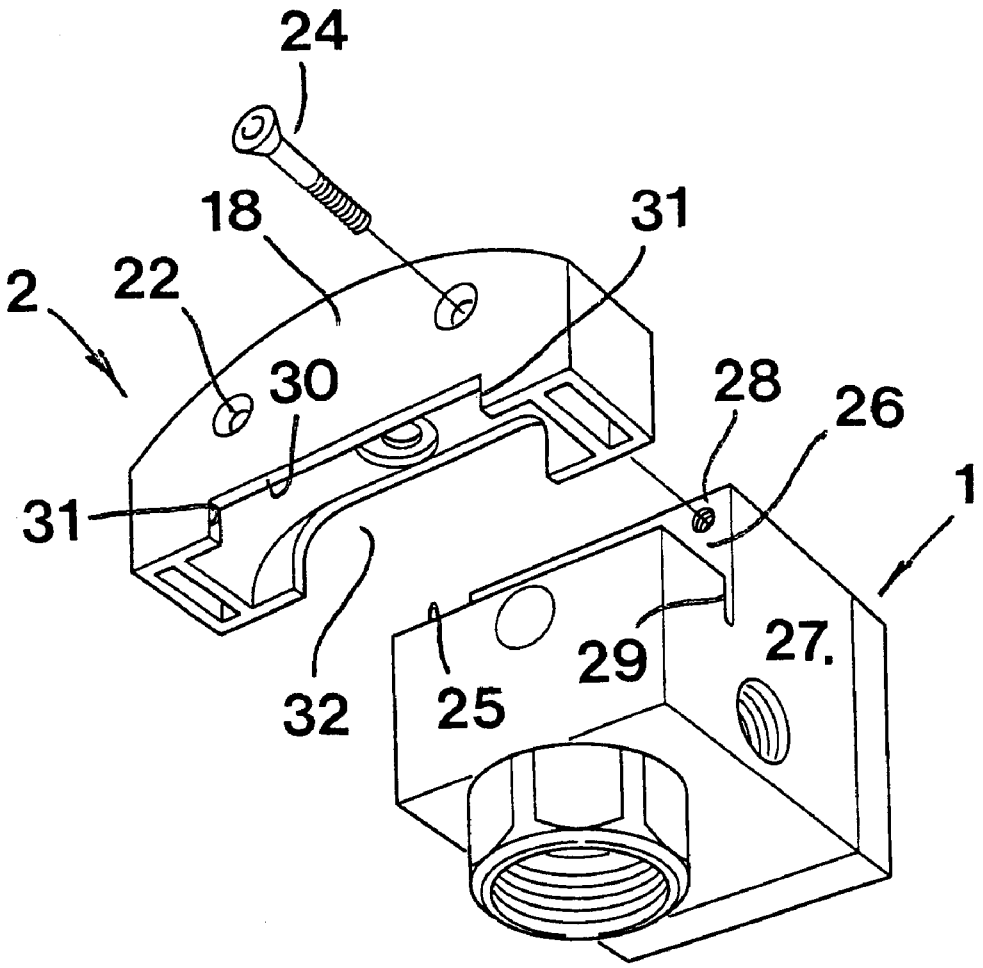

This invention relates to a nozzle device including a housing having an inlet intended for a fluid and an orifice for spraying a firm jet of fluid, which orifice is delimited by two or more members, at least one of which is movable relative to the other one between a first position in which the orifice has a minimal cross-section area in order to spray out the fluid in a firm jet in a direction forwards from the house, and a second position in which the orifice nozzle is widened in order to be flushed clean by means of a coarse stream of fluid.

PRIOR ART

A nozzle device of the art stated above is previously known by SE 9302283-8 (publ. no. 502 051). This nozzle device is particularly advantageous in comparison with conventional nozzles having an invariable diameter in so far as the nozzle device may be flushed clean during operation by the simple measure of widening the hole for a limited time, e.g., some seconds. In practice, such nozzle devices are chiefly used for spraying liquid, such as water. Although the nozzle devices may be utilized in miscellaneous sprinkling systems, the same are particularly suitable for such sprinkling systems which occur in the paper and pulp industry, and have the purpose of keeping filters and strainers clean. In such applications, the nozzle devices are usually furnished with a spoon-like member in front of the orifice, towards which member the firm jet of water is directed and reshaped to a flat and sector-shaped stream or curtain.

During practical operation it has turned out that the indeed short, but extraordinary forceful flow of water which arises when the orifice is widened in order to be cleaned, may damage the objects being sprayed. In case the ordinary firm and thin jet of water has the purpose of keeping clean, for instance, a weak filter, this filter may partially disintegrate when the nozzle device is reset and the coarse stream of flushing water hits the same with a high impact.

OBJECTS AND FEATURES OF THE INVENTION

The present invention aims at rectifying the above-mentioned drawback of the nozzle device known by SE 9302283-8 and at providing an improved nozzle device. Therefore, a primary object of the invention is to create a nozzle device which, on one hand, allows unrestricted spraying of a firm or thin jet of fluid, but which prevents that a forceful stream of flushing fluid is directed towards the object being sprayed in connection with resetting of the device for flushing clean the orifice. An additional object is to provide a nozzle device in which the short, periodical flows of flushing fluid may be utilized for flushing clean the spraying system in which the nozzle device is included, in particular the piping in which the fluid is fed to the nozzle device.

BRIEF DESCRIPTION OF THE APPENDED DRAWINGS

Figure 2:
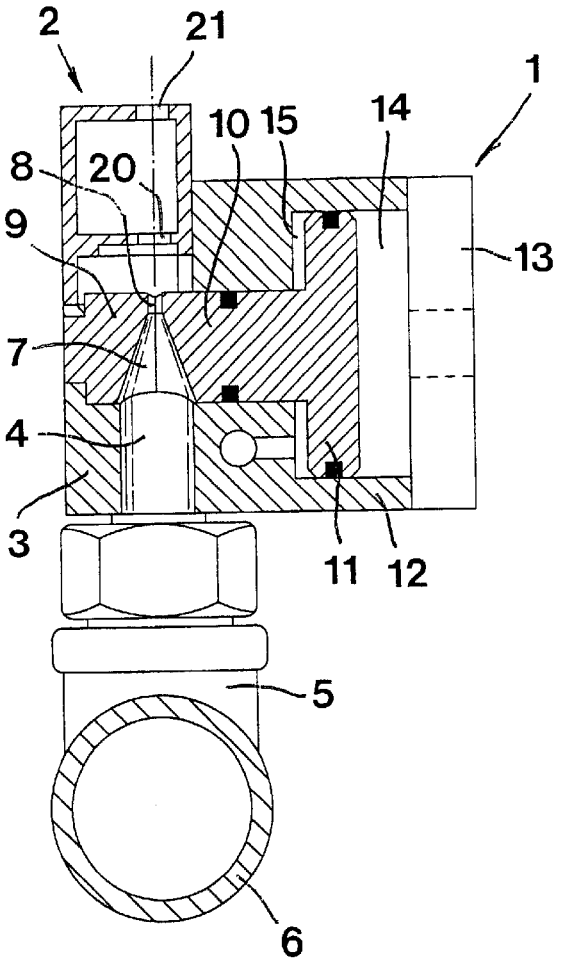
Figure 3:
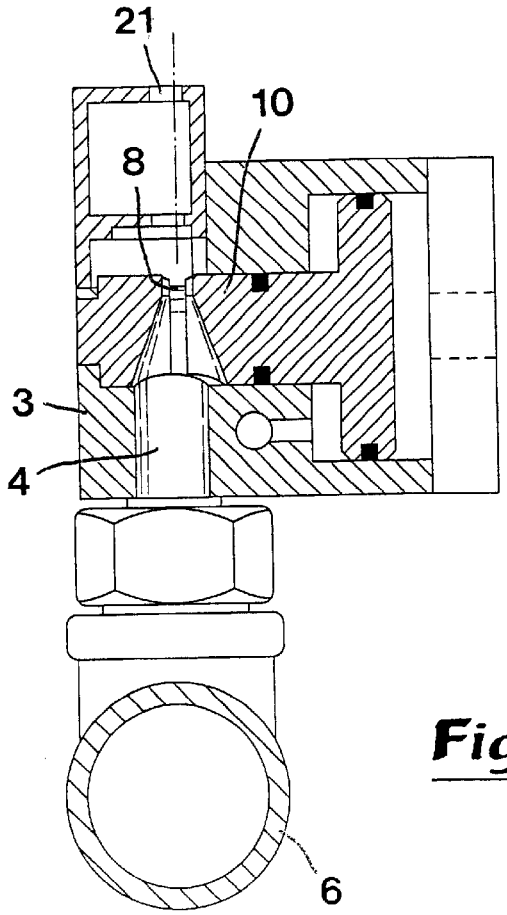
Figure 4:
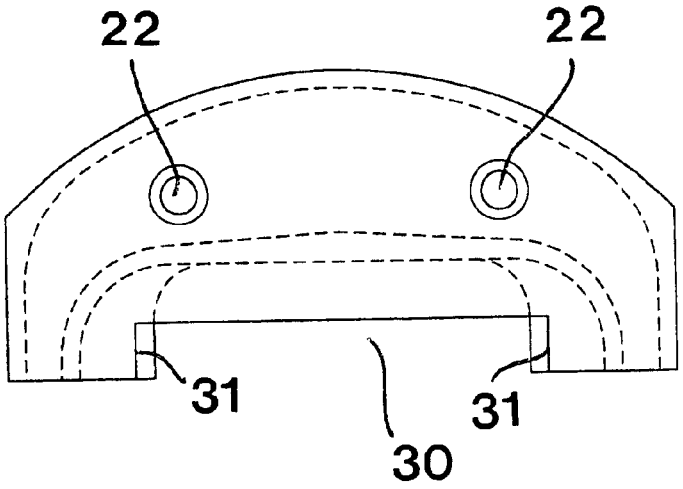
Figure 5:
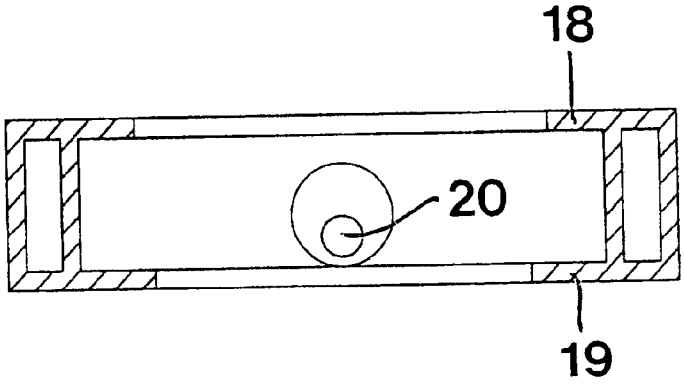
Figure 6:
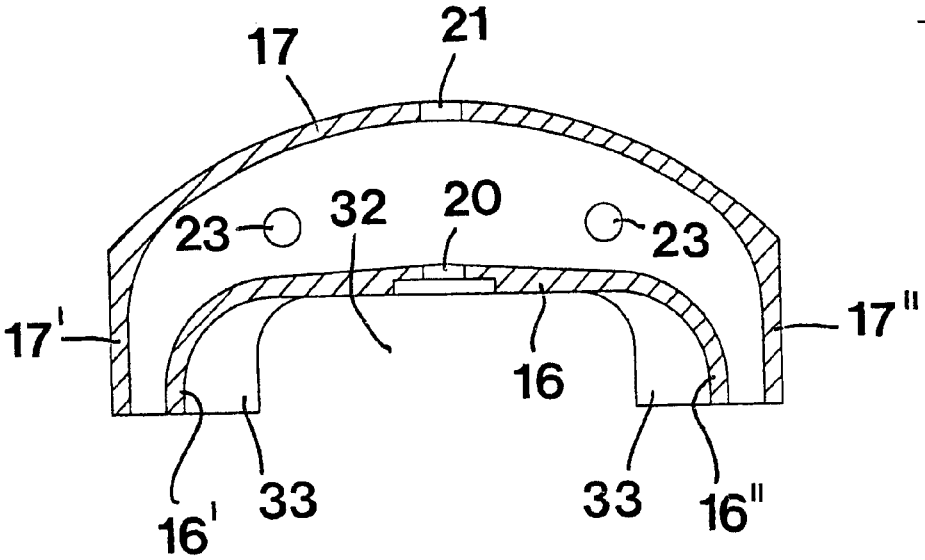
Figure 7:
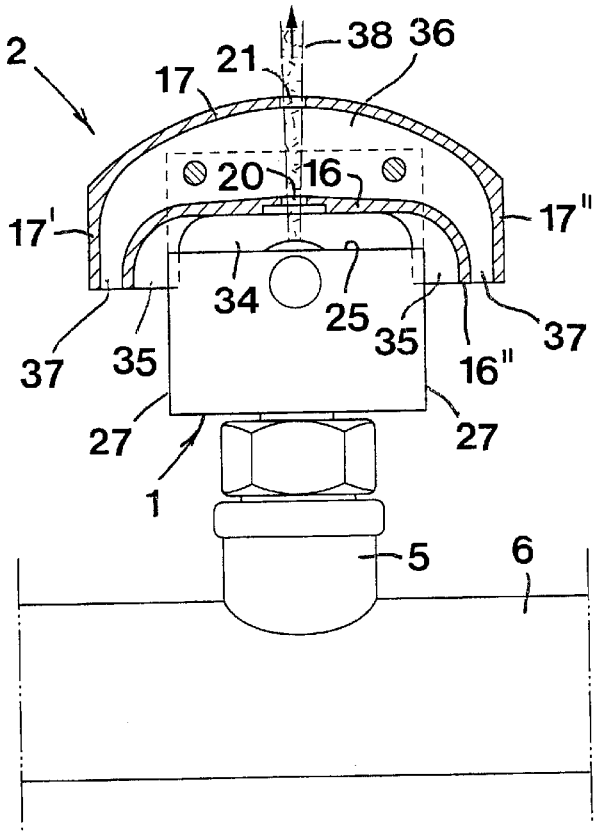
Figure 8:
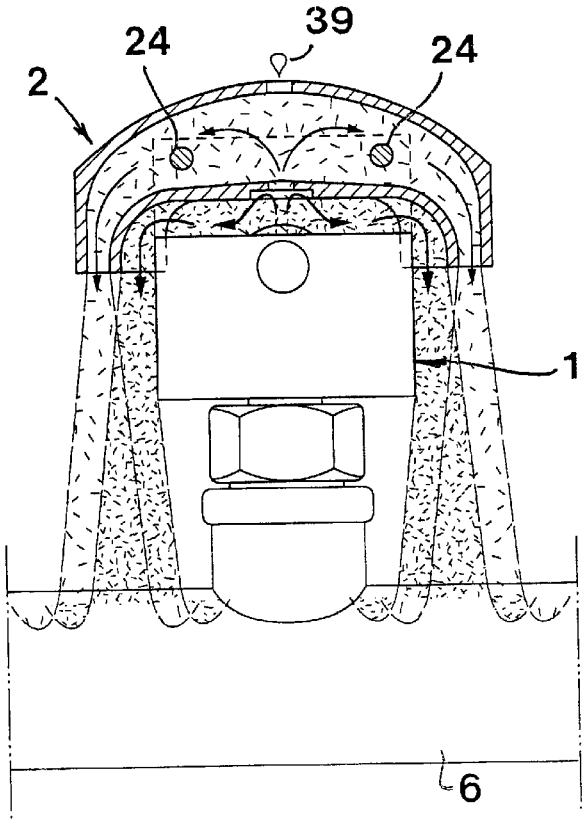

In the drawings:

FIG. 1 is a perspective exploded view showing on one hand a housing included in a nozzle device, and on the other hand a cap interacting with the housing according to the invention, FIG. 2 is a vertical section through the housing and the cap in the assembled state, the orifice of the nozzle device being shown with a minimal cross-section area for spraying a firm jet of fluid, FIG. 3 is a section corresponding to FIG. 2 showing the orifice in a widened state, FIG. 4 is a planar view of the above-mentioned cap, FIG. 5 is a cross-section through the cap according to FIG. 4, FIG. 6 is a planar-section through the cap, FIG. 7 is a partly cut side view showing the nozzle device mounted on a pipe common for several nozzle devices, the nozzle device being shown in connection with the spraying of a firm jet of fluid, and FIG. 8 is a side view corresponding to FIG. 7, showing the nozzle device during flushing the orifice clean.

DETAILED DESCRIPTION OF A PREFERRED EMBODIMENT OF THE INVENTION

The nozzle device shown in FIG. 1 includes two main components, viz. a housing 1 and a cap 2. The housing 1 and the parts included therein are in all essentials previously known by SE 9302283-8, while the cap 2 is new and unique.

Reference is now made to FIGS. 2 and 3, which illustrate the interior of the housing 1. Included in the housing is a fixed, block-like body 3 through which a bore 4 extends, which, via a branch conduit 5, is connected to a common main supply pipe 6 for several branch conduits, through which main supply liquid, such as water, may be fed to the housing. Via a cone-shaped, tapering passage 7, the bore 4 transforms into an orifice 8 of a moderate diameter. Depending on the desired flow of liquid, said orifice may have a diameter of 1 mm or more in order to form, at spraying, a firm jet chiefly of the same diameter as the orifice.

The orifice is confined between two members 9, 10, a first one 9 of which is fixedly attached to the body 3 of the housing, while the second member 10 is movable backwards and forwards in relation to the first member. The mobility of the member 10 may be realized by means of arbitrary power sources, as described in SE 9302283-8. In the example shown in FIGS. 2 and 3, the movement of member 10 backwards and forwards in relation to member 9 is achieved by means of a pressure-medium actuated piston 11 in a cylinder 12 which is closed by means of an end piece 13. By supplying pressure medium to the positive chamber 14 of the cylinder 12 and simultaneously evacuating pressure medium from the negative chamber 15, the member 10 may be moved to an inner position in which the orifice 8 has a minimal diameter. By reversing the operation, i.e. supplying pressure medium to the negative chamber 15 and evacuating pressure medium from the positive chamber 14, the member 10 may be distanced from the member 9, as shown in FIG. 3. In this manner, the orifice 8 is widened, e.g., to 3 to 5 times the initial diameter. When the orifice is adjusted to the widened state thereof according to FIG. 3, the water is allowed to pass in a forceful stream, which efficiently conveys debris, which possibly may have clogged the small orifice according to FIG. 2.

Reference is now made to FIG. 1 and FIGS. 4–6, which in detail illustrate the construction of the cap 2. In the preferred embodiment shown, the cap includes two shield walls 16, 17 extending between a top wall 18 and a bottom wall 19. Centrally in the shield walls 16, 17, there are holes 20, 21, each one of which having a diameter which is somewhat larger than the diameter of the orifice 8 when the same is in an operating state for spraying a thin jet. In practice, the diameter of the holes 20, 21 should amount 1,5-2 times the diameter of the orifice 8. The essential thing, in this respect, is that the thin jet should be able to pass the two holes 20, 21 without coming into contact with surrounding parts of the shield walls. In this context, it should be pointed out that the hole 21 may have a somewhat larger diameter than the hole 20.

The shield wall 16 is in all essentials plane and ends in oblique, rearwardly directed guiding flanges 16', 16", which have a curved shape. In the example, the guiding flanges 16', 16" are substantially quarter-cylindrical.

The other shield wall 17 is curved or arch-shaped and ends in two guiding flanges 17', 17" of a straight or planar shape.

In the top and bottom walls 18, 19, there are pair of holes 22, 23 for screws 24 (only one of which is shown in FIG. 1) by means of which the cap can be secured to the housing 1.

The housing 1 is of a generally parallelepipedical shape with the exception of a recess for the mounting of the cap 2. This recess is delimited by a front surface 25 in which the orifice 8 debouches, as well as a shoulder surface 26. The surfaces 25, 26 extend between opposite side surfaces 27 of the housing. In the shoulder surface 26, two threaded holes 28 open for the fastening screws 24. In the transition of the shoulder surface and the front surface 26, thin slots 29 are formed, which open in each one of the two side surfaces 27.

In the top wall 18 of the cap, a comparatively shallow recess 30 is formed, which extends between opposite end surfaces 31. The distance between said end surfaces 31 corresponds to the width of the housing 1. This entails that one of the end portions of the housing can be pushed into the recess 30.

In the bottom wall 19, a second recess 32 is formed which is deeper and shorter than the recess 30. In doing so, corner wall sections 33 are developed inside the guiding flanges 16, 16". These wall sections 33 can be pushed into the slots 29. When the cap is mounted on the housing, more precisely by the screws 24 being secured in appurtenant holes 28, the engagement of the corner wall sections 33 in the slots 29 will in a reliable way counteract tilting of the cap as a consequence of the forces which act against the first shield wall 16 when the same is hit by a flow of flushing water.

The Function and Advantages of the Nozzle Device According to the Invention

In FIG. 7 is shown how a first channel or duct 34 for flushing liquid is delimited between the first sheild wall 16 and the front surface 25 of the housing. By the fact that the guiding flanges 16', 16" are situated at a larger distance from each other than the side surfaces 27 of the housing, said channel 34 opens in two rearwardly directed mouths 35 in the immediate proximity of the side surfaces 27 of the housing.

In an analogous way a second channel 36 is delimited between the first shield wall 16 and the second, outer shield wall 17, said channel 36 opening in two rearwardly directed mouths 37 between the pairs of guiding flanges 16', 17' and 16" 17", respectively.

When the orifice 8 has a minimal diameter, as shown in FIG. 2, the water is sprayed out in a firm or thin jet 38, as shown in FIG. 7. Even if the diameter of the water jet may increase somewhat in the axial direction, the jet passes without obstruction through the two holes 20, 21 in the shield walls 16, 17.

When the orifice 8 is widened (see FIG. 3) in order to flush clean the orifice 8 the water will, in a shock-like or hit-like manner, plunge out in a forceful stream, the diameter of which is larger than the diameter of the hole 20. This implies that the water hits the shield wall and is deflected laterally in order to pass as turbulent partial flows in both directions through the channel 34 and further out through the mouths 35. A certain, irregular water flow may also exit through the hole 20. The main part of this water stream is, however, intercepted by the second shield wall 17 in order to be led out through the second channel 36 in a backward direction via the mouths 37. Negligible amounts of water without any substantial pressure may also exit through the hole 21, as indicated at 39 in FIG. 8. The main part of the flushing water stream is, however, directed backwards from the cap as illustrated by the dashed flowlines in FIG. 8. By the fact that the mouths 35, 37 of the deflecting channels 34, 36 are directed backwards against the main supply pipe 6, the same will become flushed clean (more precisely together with the housing as well as the branch conduit 5).

A basic advantage of the nozzle device according to the invention is that perishable objects to be flushed clean, such as filters or screens, are not hit by a forceful, thrust-resembling water stream in connection with the short, but recurrent flushing-clean operations. Another advantage is that the flushing water flow may be utilized in order to flush clean the piping system to which the nozzle device is connected, which significantly reduces the need of maintenance and the maintenance costs.

Feasible Modifications of the Invention

The invention is not limited merely to the embodiment described above and shown in the drawings. Thus, instead of two consecutive shield walls, it is feasible to use only one single shield wall in order to obstruct and deflect the stream of flushing water. Although the invention has been described in connection with the flushing of water, the same is applicable also to other arbitrary liquids or fluids. Furthermore, it should be pointed out that the nozzle device may be mounted in any arbitrary way in the room, i.e. without directing the jet precisely upwards as is exemplified in the drawings.

What is claimed is:

1. Nozzle device including a housing (1) having an inlet (4) for a fluid and an orifice (8) for spraying a firm jet of fluid, which orifice is delimited by two or more members (9, 10), at least one (10) of which is movable relative to the other one (9) between a first position in which the orifice (8) has a minimal cross-section area in order to spray out the fluid in a firm jet (38) in a direction forwards from the housing (1), and a second position in which the orifice is widened in order to be flushed clean by means of a coarse stream of fluid, characterized in that in front of the orifice (8) a cap (2) is arranged having at least one shield wall (16) in which there is a hole (20) through which the firm jet of fluid, but not the coarse stream of flushing fluid, may pass.

2. Nozzle device according to claim 1, characterzed in that the cap (2) comprises separate top and bottom walls (18, 19) between which the shield wall (16) extends in order to delimit a channel (34) through which the flushing fluid is led out sidewards from the orifice (8).

3. Nozzle device according to claim 2, characterized in that the shield wall (16) at opposite ends has oblique, rearwardly directed guiding flanges (16', 16") having the purpose of leading out the flushing fluid in two generally rearwardly directed flows along the sides (27) of the housing (1).

4. Nozzle device according to claim 2, characterized in that the cap (2) includes two separate shield walls (16, 17)

between which a second flushing fluid channel (36) is delimited and in which there are holes (20, 21), both of which are in flush with said orifice (8) and have a larger diameter than the minimal diameter thereof.

5. Nozzle device according to claim 3, characterzed in that the cap (2) includes two separate shield walls (16, 17) between which a second flushing fluid channel (36) is delimited and in which there are holes (20, 21), both of which are in flush with said orifice (8) and have a larger diameter than the minimal diameter thereof.

* * * * *